US009351620B2

(12) United States Patent
Frank et al.

(10) Patent No.: US 9,351,620 B2
(45) Date of Patent: May 31, 2016

(54) VACUUM CLEANER

(71) Applicant: Alfred Kärcher GmbH & Co. KG, Winnenden (DE)

(72) Inventors: Jürgen Frank, Kirchberg (DE); Kai Thorsten Langen, Stuttgart (DE); Maic Hensel, Backnang (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 371 days.

(21) Appl. No.: 13/895,041

(22) Filed: May 15, 2013

(65) Prior Publication Data

US 2013/0247328 A1 Sep. 26, 2013

Related U.S. Application Data

(63) Continuation of application No. PCT/EP2010/067564, filed on Nov. 16, 2010.

(51) Int. Cl.

| | |
|---|---|
| ***A47L 9/14*** | (2006.01) |
| ***A47L 5/22*** | (2006.01) |
| ***A47L 5/36*** | (2006.01) |
| ***A47L 9/00*** | (2006.01) |
| ***A47L 9/12*** | (2006.01) |
| ***A47L 9/20*** | (2006.01) |
| ***A47L 9/22*** | (2006.01) |

(52) U.S. Cl.

CPC ... *A47L 9/14* (2013.01); *A47L 5/22* (2013.01); *A47L 5/365* (2013.01); *A47L 9/0081* (2013.01); *A47L 9/122* (2013.01); *A47L 9/20* (2013.01); *A47L 9/22* (2013.01)

(58) Field of Classification Search

CPC ..... A47L 9/1683; A47L 5/28; A47L 9/1666; A47L 9/1691; A47L 9/127

See application file for complete search history.

(56) References Cited

U.S. PATENT DOCUMENTS

| | | | | |
|---|---|---|---|---|
| 2006/0179601 | A1 | 8/2006 | Crevling, Jr. et al. | |
| 2008/0086835 | A1 | 4/2008 | Stewen et al. | |
| 2009/0193612 | A1 * | 8/2009 | Weiss et al. | 15/347 |
| 2009/0205499 | A1 | 8/2009 | Eckstein et al. | |
| 2010/0154367 | A1 | 6/2010 | Luo et al. | |

FOREIGN PATENT DOCUMENTS

| | | |
|---|---|---|
| CN | 101388578 | 3/2009 |
| DE | 20 2004 012 911 | 11/2004 |

(Continued)

*Primary Examiner* — Robert Scruggs

(74) *Attorney, Agent, or Firm* — Womble Carlyle Sandridge & Rice LLP

(57) ABSTRACT

A vacuum cleaner is provided with a dirt collection container and a suction head which can be placed on the dirt collection container, wherein the suction head has at least one suction unit which is in flow communication with the dirt collection container via a suction duct and a filter device and with at least one exhaust air opening via at least one exhaust air duct. To provide high suction capacity, a compact construction, and relatively little generation of noise during operation, the suction head has two suction units arranged next to one another, positioned in a vertical direction at the same level as the filter device and surrounded by a common exhaust air chamber, wherein the exhaust air chamber is in flow communication with exhaust air openings via a first and a second exhaust air duct and the filter device is arranged between the two exhaust air ducts.

13 Claims, 4 Drawing Sheets

(56) References Cited

FOREIGN PATENT DOCUMENTS

| | | | |
|---|---|---|---|
| GB | 1 386 055 | 3/1975 | |
| GB | 001386055 | * | 3/1975 |
| SU | 1602442 | | 10/1990 |
| WO | WO 2007/065992 | | 6/2007 |
| WO | WO 2010/121656 | | 10/2010 |

* cited by examiner

VACUUM CLEANER

CROSS-REFERENCE TO RELATED APPLICATIONS

This application is a continuation of international application number PCT/EP2010/067564, filed on Nov. 16, 2010, which is incorporated herein by reference in its entirety and for all purposes.

BACKGROUND OF THE INVENTION

The invention relates to a vacuum cleaner with a dirt collection container and a suction head which can be placed on the dirt collection container, wherein the suction head has at least one suction unit which is in flow communication with the dirt collection container via a suction duct and a filter device and with at least one exhaust air opening via at least one exhaust air duct.

Vacuum cleaners of this type are known in many variations. The dirt collection container is often configured like a bucket, onto which the suction head can be placed. The suction head comprises at least one suction unit, with the aid of which the dirt collection container can be acted upon with a vacuum. This allows suction material to be taken up from a surface, for example a floor surface, and transferred to the dirt collection container. The flow connection between the dirt collection container and the at least one suction unit is brought about via a suction duct and a filter device. The suction air drawn in by the dirt collection container can be filtered by means of the filter device. The suction air drawn in will be discharged to the surroundings from the at least one suction unit. For this purpose, the at least one suction unit is in flow communication with at least one exhaust air opening via at least one exhaust air duct. In many cases, the exhaust air opening is configured in the form of exhaust air slits which are arranged in a dome-shaped housing of the suction head.

Vacuum cleaners of the type specified at the outset should, on the one hand, have a high suction capacity so that a surface to be cleaned can be vacuumed off within a short period of time, wherein coarse suction material will also be transferred from the surface to the dirt collection container. On the other hand, the vacuum cleaners are intended to have as compact a construction as possible and the operation of the vacuum cleaner be associated with as little generation of noise as possible.

The object of the present invention is, therefore, to develop a vacuum cleaner of the type specified at the outset further in such a manner that it has a high suction capacity and a compact construction and its operation is associated with relatively little generation of noise.

SUMMARY OF THE INVENTION

This object is accomplished in accordance with the invention, in a vacuum cleaner of the generic type, in that the suction head has two suction units which are arranged next to one another and are positioned at the same level as the filter device in a vertical direction and are surrounded by a common exhaust air chamber, wherein the exhaust air chamber is in flow communication with exhaust air openings via a first and a second exhaust air duct and the filter device is arranged between the two exhaust air ducts.

The vacuum cleaner according to the invention is characterized by a high suction capacity. For this purpose, it has two suction units. The two suction units are arranged next to one another and next to the filter device, in a vertical direction the two suction units are located at the same level as the filter device. This gives the vacuum cleaner a compact construction. The generation of noise by the two suction units will be kept relatively small in that they are surrounded by a common exhaust air chamber, from which the exhaust air of the suction units can be discharged to exhaust air openings via two exhaust air ducts. The filter device is located between the two exhaust air ducts. This improves the compact configuration of the vacuum cleaner. The provision of the exhaust air ducts has, in addition, the advantage that the generation of noise by the vacuum cleaner can be kept particularly small.

It is inexpensive when the two suction units are of an identical construction. This simplifies the assembly of the vacuum cleaner.

It is of particular advantage with a view to a compact construction when the two suction units are aligned vertically, i.e., when the motor axes of the electric motors of the suction units are aligned vertically.

The filter device is designed as a flat-fold filter in one preferred development of the invention. In this respect, it is favorable when the flat-fold filter can be replaced on the clean side. This has the advantage that the user does not come into contact with very dirty areas of the vacuum cleaner when replacing the flat-fold filter. The flat-fold filter can have, for example, a filter cartridge which is accessible to the user on the side of the filter downstream with respect to the direction of flow of the suction air.

It is of particular advantage with a view to a simple handling of the vacuum cleaner when it has a filter cleaning device, with which the filter device can be cleaned off As already mentioned, the suction air can be filtered by means of the filter device. In this respect, the filter device gradually becomes clogged with dirt particles during the course of the operating time and so the filter device puts up an increasing flow resistance to the suction air and, as a result, the suction capacity of the vacuum cleaner will increasingly be reduced. It is, therefore, of advantage when the filter device can be cleaned off In one advantageous embodiment, the vacuum cleaner therefore has a filter cleaning device.

With a view to a compact design, it is advantageous when the filter cleaning device is arranged above the filter device. The filter cleaning device can have, for example, an external air valve which can be opened for the purpose of cleaning off the filter, wherein external air can flow abruptly into the suction duct via the external air valve and act on the filter device on its side facing away from the dirt collection container. This leads to a mechanical jarring of the filter device. In addition, at least some of the external air flowing in via the external air valve flows through the filter device contrary to the direction of flow prevailing during the normal suction operation. As a result, the removal of dirt particles from the filter device is intensified.

The filter cleaning device can advantageously be controlled electrically. It can be provided, for example, for the filter cleaning device to have an electromagnet, with the aid of which the external air valve can be actuated electrically by a control device of the vacuum cleaner.

In order to keep the generation of noise by the vacuum cleaner particularly low, it is favorable when the exhaust air ducts are of a straight line configuration. The exhaust air ducts form settling zones for the exhaust air. The occurrence of air turbulences is kept small, as a result. As a result, a powerful generation of noise can be avoided.

The exhaust air ducts are preferably aligned horizontally.

An additional reduction in noise is achieved in one advantageous development of the vacuum cleaner according to the invention in that the exhaust air chamber and/or the exhaust air ducts are lined with an insulating material at least in sections. Insulating mats, in particular, such as those known per se to the person skilled in the art, can be used as insulating material.

It is favorable when the exhaust air chamber surrounds the two suction units completely in circumferential direction. Such a design has the advantage that the suction air which is drawn in by the suction units can be delivered to the exhaust air chamber over the entire circumference of the suction units. Subsequently, the exhaust air can then be passed to the surroundings via the two exhaust air ducts and the exhaust air openings adjoining them.

The suction head has, in one preferred design, a bottom wall, on which an exhaust air cover is seated, wherein the bottom wall and the exhaust air cover define the exhaust air chamber. The exhaust air chamber therefore extends between the bottom wall of the suction head and the exhaust air cover.

The two exhaust air ducts can follow on from the exhaust air cover.

It is of advantage when two extensions are integrally formed on the exhaust air cover and form the exhaust air ducts in combination with the bottom wall. The exhaust air ducts and the exhaust air chamber are formed, in such a configuration of the invention, by the bottom wall of the suction head and the exhaust air cover including the extensions.

The exhaust air cover preferably has two openings, each of which is penetrated by a suction housing, wherein the suction housings each accommodate a suction unit and wherein a vibration-insulating material is arranged between the suction housings and the exhaust air cover. The suction housings can each serve the purpose of mounting a suction unit. Mechanical vibrations which are transferred by the suction units to the suction housings cannot be transferred automatically to the exhaust air cover since a vibration-insulating material, for example a foamed rubber seal, is arranged between the exhaust air cover and the suction housings.

The suction housings are favorably connected detachably to the bottom wall. They can, for example, be screwed to the bottom wall.

The suction head advantageously has an outer covering which covers the exhaust air cover. This leads to a further reduction in noise.

The suction duct, via which the suction turbines are in flow communication with the dirt collection container, has, in one advantageous embodiment, a duct section which extends vertically and is arranged between the filter device and the exhaust air cover. This makes a particularly compact construction of the vacuum cleaner according to the invention possible.

The following description of one preferred embodiment of the invention serves to explain the invention in greater detail in conjunction with the drawings.

DETAILED DESCRIPTION OF THE INVENTION

Figure 1:
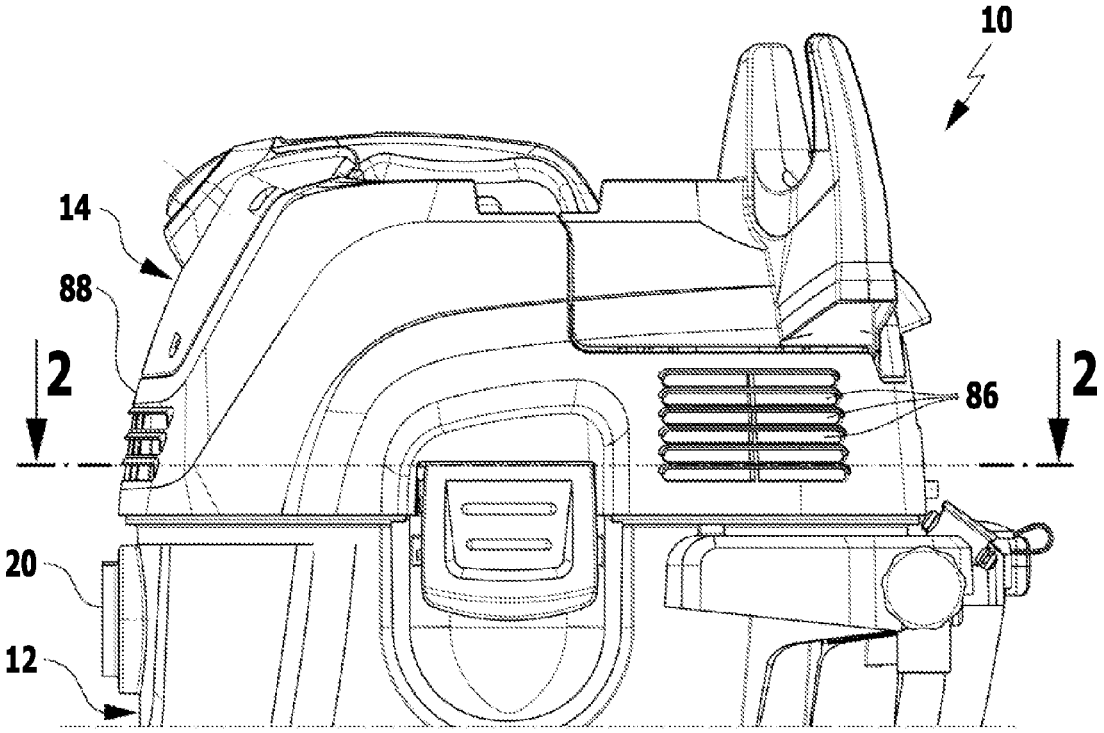
FIG. 1 shows a partial side view of a vacuum cleaner according to the invention with a dirt collection container and a suction head.

A preferred embodiment of a vacuum cleaner according to the invention, which is given, altogether, the reference numeral 10, is illustrated schematically in the drawings. The vacuum cleaner comprises a dirt collection container 12, onto which a suction head 14 is placed. A first suction unit 16 and a second suction unit 18, with the aid of which the dirt collection container 12 can be acted upon with a vacuum, are arranged in the suction head. The dirt collection container 12 comprises a suction inlet 20, to which a suction hose, which is known per se to the person skilled in the art, can be connected in the customary manner and which can bear a suction nozzle at its free end facing away from the dirt collection container 12. This allows a surface, in particular a floor surface, to be vacuumed, wherein suction material from the surface can be drawn into the dirt collection container 12 via the suction inlet 20.

The two suction units 16 and 18 each comprise an electric motor 22 and 24, respectively, which drives a suction turbine 26 and 28, respectively. The electric motors 22, 24 are, like the suction turbines 26, 28, aligned vertically, i.e. the motor and turbine axes extend in a vertical direction. The electric motors 22, 24 are positioned above the suction turbines 26 and 28, respectively.

The flow connection of the two suction units 16, 18 to the dirt collection container 12 is brought about via a suction duct 30 and a filter device 32. The filter device 32 is arranged at a suction outlet 34 of a bottom wall 36 of the suction head 14 and designed in the form of a flat-fold filter 38.

The suction duct 30 comprises a horizontal duct section 40 which extends along the upper side of the filter device 32 facing away from the dirt collection container 12 as well as a vertical duct section 42 which follows on from the horizontal duct section 40 and extends as far as end sections 44, 46 which are arranged beneath the suction turbines 26 and 28, respectively.

The suction units 16 and 18 are each arranged in a pot-shaped suction housing 48 and 50, respectively, which has at the level of the suction turbines 26 and 28, respectively, a plurality of housing openings which are not illustrated in the drawings and via which the suction air drawn in can be discharged. The suction units 16 and 18 are, for this purpose, surrounded by a common exhaust air chamber 52 which is defined by an exhaust air cover 54 and the bottom wall 36. The exhaust air cover 54 has a first opening 56 and a second opening 58 on its upper side facing away from the bottom wall 36. The first opening 56 has the suction housing 48 of the first suction unit 16 passing through it and the second opening 58 has the suction housing 50 of the second suction unit 18 passing through it. A vibration-insulating material in the form of a foamed rubber seal 60 and 62, respectively, is arranged between each of the suction housings 48 and 50, on the one hand, and the exhaust air cover 54, on the other hand. Mechanical vibrations will not, therefore, be automatically transferred to the exhaust air cover 54 from the suction housings 48, 50, each of which mounts a suction unit 16 and 18, respectively.

The suction housings 48, 50 are detachably connected to the bottom wall 36 by means of connecting screws 64.

Figure 2:
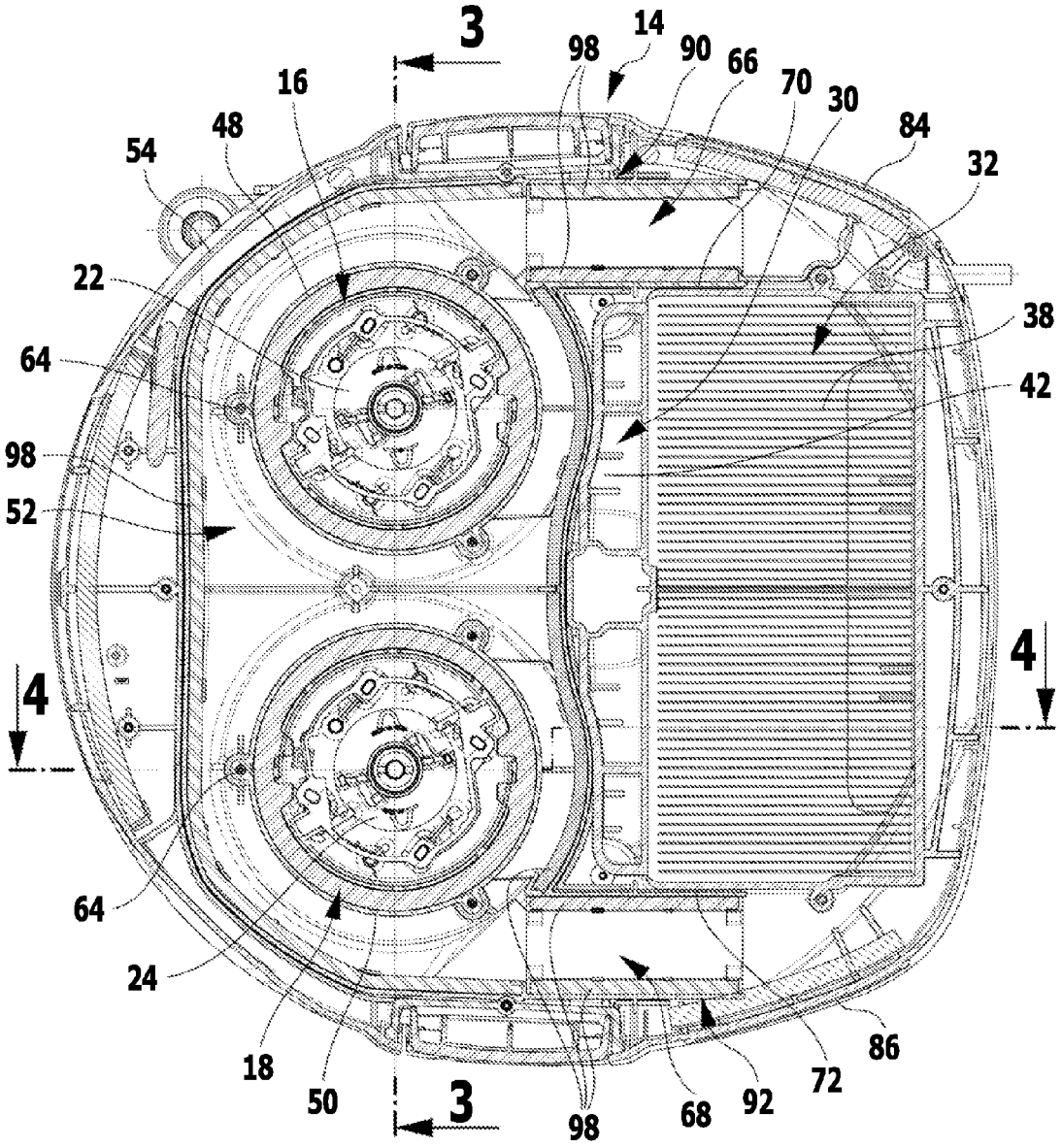
FIG. 2 shows a sectional view of the suction head along line 2-2 in FIG. 1.
Figure 3:
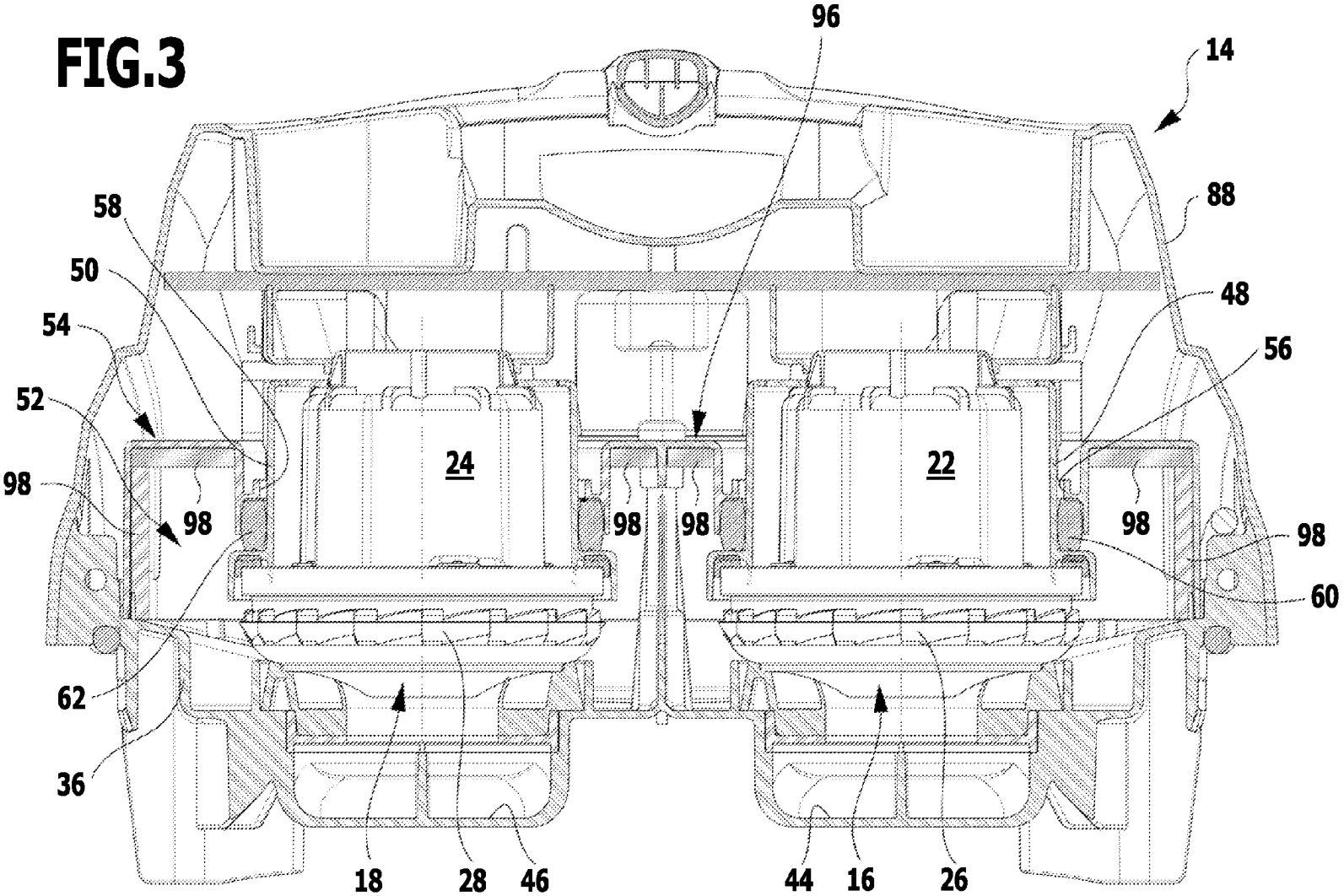
FIG. 3 shows a sectional view of the suction head along line 3-3 in FIG. 2.

The exhaust air chamber 52 is followed in a horizontal direction by a first exhaust air duct 66 and a second exhaust air duct 68 of an identical design, the ducts each being of a straight line configuration and extending in a horizontal direction along transverse sides of the filter device 32 which face away from one another. The filter device 32 is arranged between the first exhaust air duct 66 and the second exhaust air duct 68 and is located in a vertical direction at the same level as the two suction units 16 and 18. This is apparent, in particular, from FIGS. 2 and 4.

Figure 4:
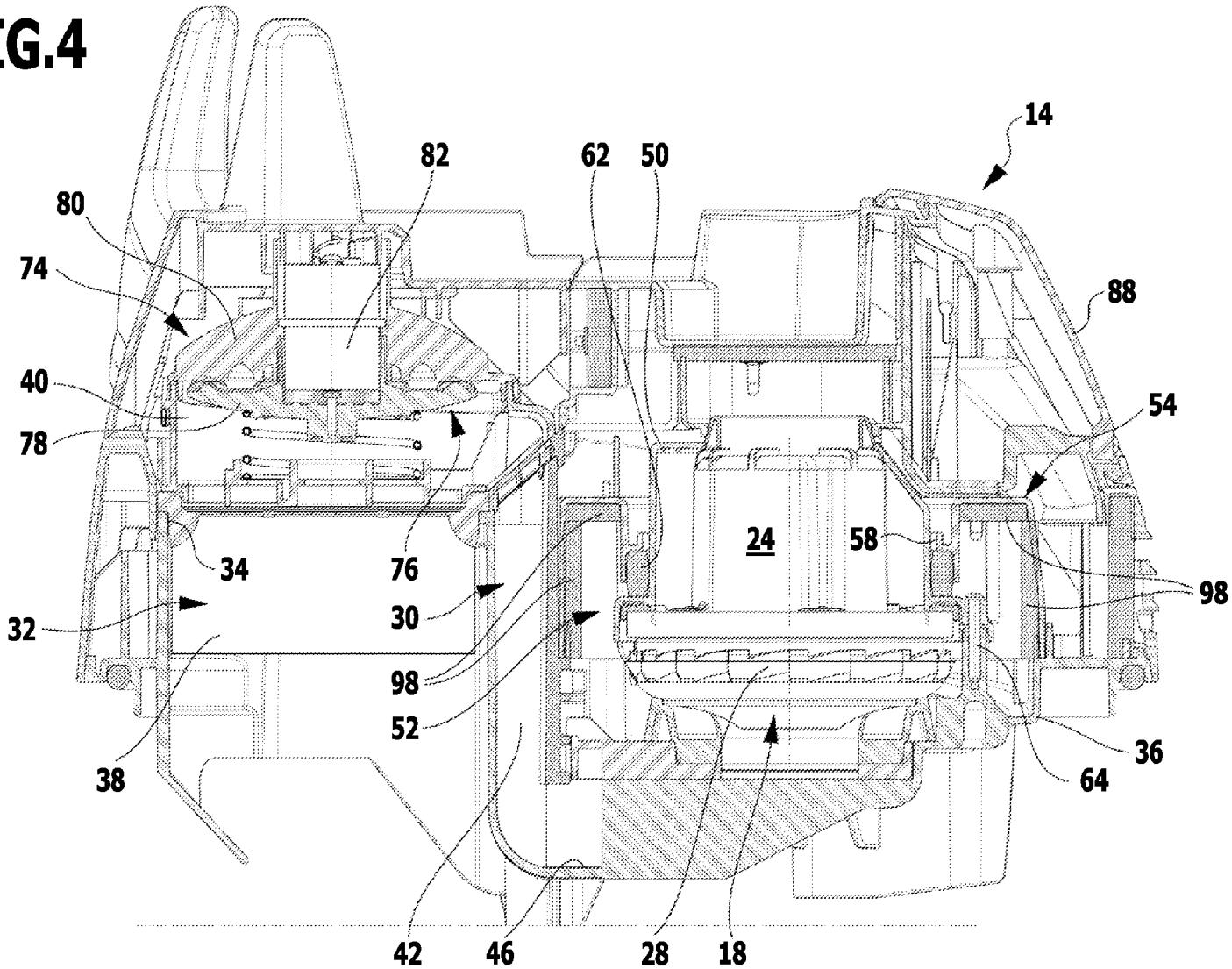
FIG. 4 shows a sectional view of the suction head along line 4-4 in FIG. 2.

A filter cleaning device 74 is arranged in the suction head 14 above the filter device 32. This cleaning device comprises an external air valve 76 with a valve plate 78 which can be moved back and forth in a vertical direction and abuts sealingly on a valve housing 80 in its closed position, as illustrated in FIG. 4, and, as a result, closes the external air valve 76.

The valve plate 78 is held in its closed position by means of an electromagnet 82. The external air valve 76 can be opened for a short time for the purpose of cleaning off the filter device 32. As a result, external air can penetrate the horizontal duct section 40 of the suction duct 30 and act mechanically on the side of the filter device 32 facing away from the dirt collection container 12. This leads to a mechanical jarring of the filter device 32 which results in dirt particles adhering to the underside of the filter device 32, which faces the dirt collection container 12, being removed. In addition, at least some of the external air flows through the filter device 32 contrary to the direction of flow which is formed during the normal suction operation of the vacuum cleaner 10. As a result, the removal of dirt particles from the filter device 32 is amplified.

During normal suction operation, the external air valve 76 is closed and so the dirt collection container 12, as already mentioned, can be acted upon with a vacuum by means of the two suction units 16 and 18.

The suction air drawn in by the suction units 16, 18 can be fed to exhaust openings 84, 86, via which the exhaust air can be discharged to the surroundings, via the common exhaust air chamber 52 and the straight line exhaust air ducts 66, 68 following on therefrom. The exhaust air openings 84, 86 are designed in the form of exhaust air slits which are integrally formed in an outer covering 88 of the suction head 14. This is apparent from FIG. 1.

The exhaust air ducts 66 and 68 are formed, on the one hand, by channel-like extensions 90, 92 of the exhaust air cover 54, which are of a U-shaped design in the embodiment illustrated, and the bottom wall 36, on the other hand. The extensions 90, 92 are integrally formed on the exhaust air cover 54 and so they form in combination with the exhaust air cover 54 a one-piece exhaust air guiding element 96 of the suction head 14 which is seated on the bottom wall 36 and surrounds the suction units 16, 18 in circumferential direction.

The exhaust air guiding element 96 is arranged in a vertical direction at the same height as the filter device 32 and the vertical duct section 42 of the suction duct 30 is arranged between the filter device 32 and the exhaust air guiding element 96. This is apparent, in particular, from FIG. 2.

The exhaust air guiding element 96 is lined for the most part with an insulating material in the form of an insulating mat 98 which serves to reduce the noise.

The vacuum cleaner 10 according to the invention has a high suction capacity on account of the use of the two suction units 16 and 18. Despite this high suction capacity, it is characterized by a low generation of noise. Operational noise which occurs is kept low by the provision of the exhaust air chamber 52 and the adjoining straight line exhaust air ducts 66, 68 as well as by the use of the insulating mat 98. The vacuum cleaner 10 is characterized, in addition, by a compact construction. This is achieved, in particular, due to the fact that the two suction units 16, 18 are arranged, in a vertical direction, at the same level as the filter device 32, wherein the exhaust air ducts 66 and 68 extend along the transverse sides 70, 72 of the filter device 32 which is thus arranged between the two exhaust air ducts 66, 68.

That which is claimed:

1. A vacuum cleaner with a dirt collection container and a suction head adapted to be placed on the dirt collection container, wherein the suction head has at least one suction unit in flow communication with the dirt collection container via a suction duct and a filter device and with at least one exhaust air opening via at least one exhaust air duct, wherein the suction head has two suction units arranged next to one another, said suction units being positioned at the same level as the filter device in a vertical direction and surrounded by a common exhaust air chamber, wherein the exhaust air chamber is in flow communication with exhaust air openings via a first and a second exhaust air duct and the filter device is arranged between the two exhaust air ducts, wherein the suction head has a bottom wall, an exhaust air cover defining the exhaust air chamber in combination with the bottom wall being seated on said bottom wall, and wherein two extensions are integrally formed on the exhaust air cover and define the exhaust air ducts in combination with the bottom wall.

2. The vacuum cleaner as defined in claim 1, wherein the two suction units are of an identical construction.

3. The vacuum cleaner as defined in claim 1, wherein the two suction units are aligned vertically.

4. The vacuum cleaner as defined in claim 1, wherein the filter device has a flat-fold filter.

5. The vacuum cleaner as defined in claim 1, wherein a filter cleaning device is arranged above the filter device.

6. The vacuum cleaner as defined in claim 1, wherein the exhaust air ducts are of a straight line configuration.

7. The vacuum cleaner as defined in claim 1, wherein the exhaust air ducts are aligned horizontally.

8. The vacuum cleaner as defined in claim 1, wherein the exhaust air chamber and/or the exhaust air ducts are lined with an insulating material at least in sections.

9. The vacuum cleaner as defined in claim 1, wherein the exhaust air chamber surrounds the suction units completely in circumferential direction.

10. The vacuum cleaner as defined in claim 1, wherein the exhaust air cover has two openings each penetrated by a suction housing, wherein the suction housings each accommodate a suction unit and a vibration-insulating material is arranged between the suction housings and the exhaust air cover.

11. The vacuum cleaner as defined in claim 10, wherein the suction housings are detachably connected to the bottom wall.

12. The vacuum cleaner as defined in claim 1, wherein the suction head has an outer covering covering the exhaust air cover.

13. The vacuum cleaner as defined in claim 1, wherein the suction duct has a duct section extending vertically, said section being arranged between the filter device and the exhaust air cover.

* * * * *